US006191740B1

(12) United States Patent
Kates et al.

(10) Patent No.: US 6,191,740 B1
(45) Date of Patent: Feb. 20, 2001

(54) SLOT FED MULTI-BAND ANTENNA

(75) Inventors: Ronald M. Kates, Newbury Park; Peter Petre, Agoura, both of CA (US)

(73) Assignee: Hughes Electronics Corporation, El Segundo, CA (US)

( * ) Notice: Under 35 U.S.C. 154(b), the term of this patent shall be extended for 0 days.

(21) Appl. No.: 09/327,443

(22) Filed: Jun. 5, 1999

(51) Int. Cl.[7] ..... H01Q 1/38
(52) U.S. Cl. ..... 343/700 MS; 343/767; 343/795
(58) Field of Search ..... 343/700 MS, 767, 343/770, 795; H01Q 1/38

(56) References Cited

U.S. PATENT DOCUMENTS 4,710,775 * 12/1987 Coe ..... 343/767
5,355,143 * 10/1994 Zurcher et al. ..... 343/767

* cited by examiner

*Primary Examiner*—Michael C. Wimer
(74) *Attorney, Agent, or Firm*—V. D. Duraiswamy; M. W. Sales

(57) ABSTRACT

An antenna circuit, a method of manufacturing, and a method of operating the same are provided. An antenna member, a first dielectric layer, a top ground plane, a radiating slot ring through the top ground plane, a second dielectric layer, a stripline feed member, a third dielectric layer, and a bottom ground plane are all laminated together within a specified arrangement to form an efficient multi-band micro-strip antenna circuit. A micromachined electromagnetic switch is utilized to alter the length of the antenna member, thereby producing resonant frequencies which correlate with those radiated by the ring slot.

15 Claims, 3 Drawing Sheets

FIG. 1
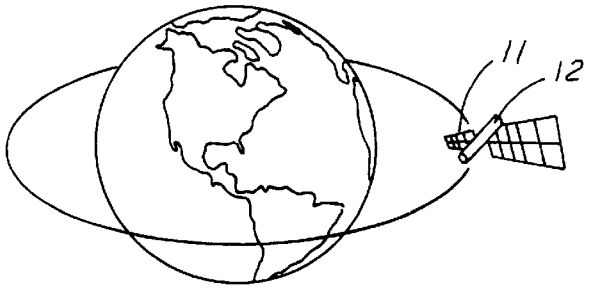
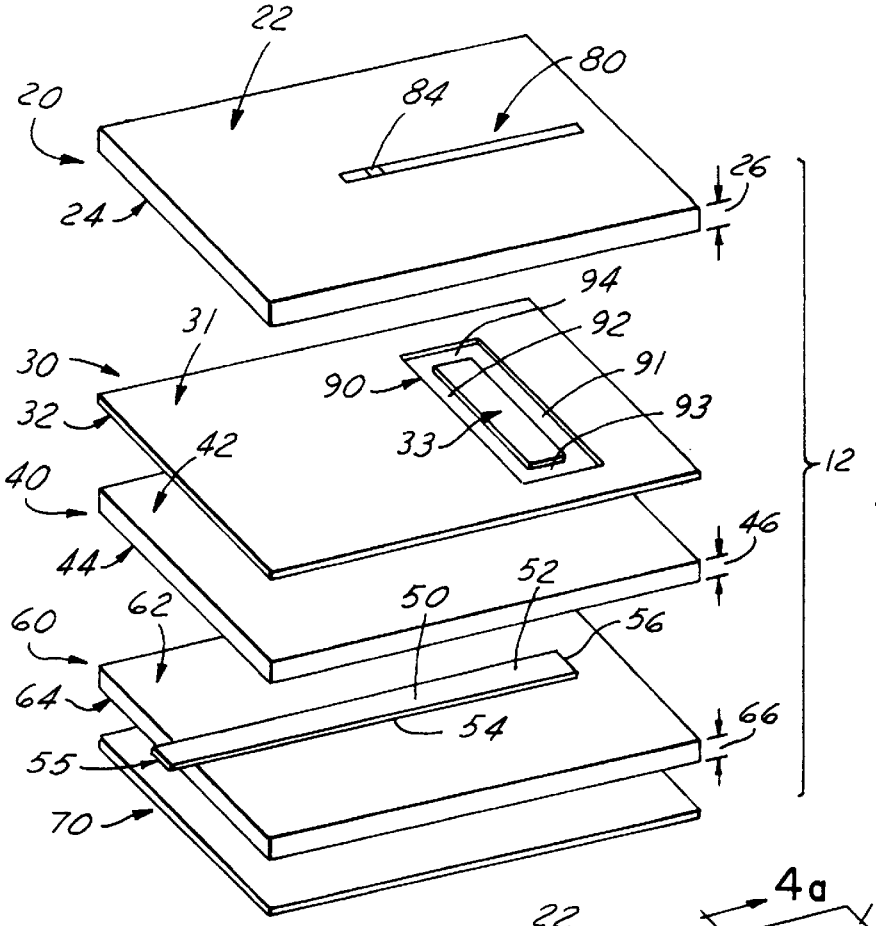
FIG. 2
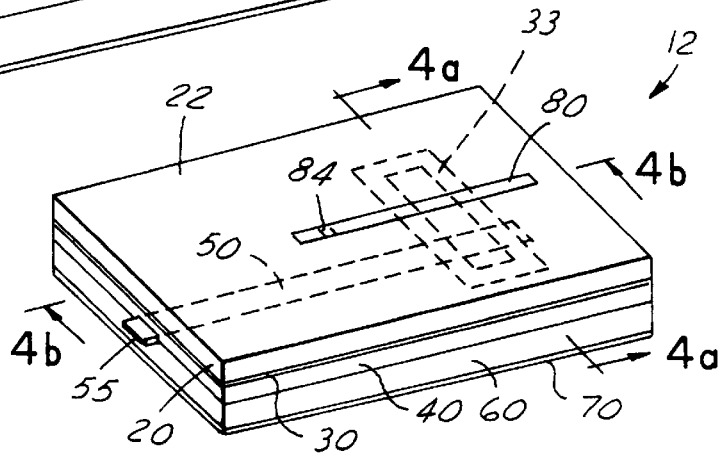
FIG. 3

SLOT FED MULTI-BAND ANTENNA

TECHNICAL FIELD

This invention relates to a multi-band antenna and, more particularly, to a slot fed multi-band antenna for utilization in millimeter-wave to radio frequency antenna applications.

BACKGROUND ART

It is well-known in the art that microstrip antenna arrays radiate efficiently as devices on printed circuit boards. These arrays typically consist of microstrip antenna elements, dielectric substrates, and feed and phasing networks, along with other microstrip devices. The lightweight and compact design of microstrip antennas make them suitable for use in airborne and satellite applications.

One type of microstrip antenna is a slot fed antenna. The slot fed antenna typically operates at a single frequency band. If an application requires multiple frequencies, then multiple slot-fed antenna circuits are integrated within an array to perform the required system function.

This integration may cause potential problems with the antenna system. The individual circuits used in combination to radiate multiple signals add unwanted mass to the system. Also, multiple circuits utilize much needed space within a satellite application. Additionally, multiple circuits must be individually joined, or interfaced, which requires more assembly time, thereby adding cost to the antenna system.

It is an object of the present invention to provide an improved slot fed antenna and an improved antenna circuit. It is also an object of the present invention to provide a slot fed antenna which transmits multiple frequency bands.

SUMMARY OF THE INVENTION

The present invention relates to a multi-band slot fed antenna which is capable of transmitting or receiving at two or more frequency bands with an antenna member capable of operating at different lengths, each length having a characteristic resonance frequency. The inventive antenna includes a bottom ground plane, a single stripline feed member, a top ground plane, a ring slot, and an antenna member having a switch, all configured within a dielectric substrate. Coupled with the resonant frequencies are radiating frequencies radiated by the ring slot appropriately positioned through the top ground plane over the stripline feed member.

The top ground plane and the bottom ground plane are held at the same potential and extend out sufficiently to prevent unwanted radiation. In order for the antenna to operate at multiple frequencies, a plurality of radiating slots are positioned through the top ground plane and a plurality of varying antenna member lengths are provided. The bottom ground plane also serves as the bottom ground for the stripline feed member and eliminates any direct back radiation from the antenna member and radiating ring slot.

The ability of the present invention to operate at multiple frequencies eliminates the drawbacks of the previous art. No longer must multiple circuits be combined in order to radiate multiple signals. The smaller size inherent with the single circuit of the present invention saves space and utilizes less mass than known antenna circuits. In addition, since the integration of multiple circuits is no longer required, manufacturing is simplified, thereby reducing cost.

The present invention can be used in any commercial, military or automotive application that requires a multiple frequency antenna. Such uses include, for example, distance tracking, scanning arrays, Doppler systems, GPS and communications in the cellular and wireless industries.

A more complete understanding of the present invention can be determined from the following detailed description when taken in view of the attached drawings and the claims appended hereto.

BRIEF DESCRIPTION OF THE DRAWINGS

These above and other objects, advantages, and features of the present invention will be apparent to those skilled in the antenna arts upon reading the following description with reference to the accompanying drawings, in which:

FIG. 1 is an antenna circuit within a satellite environment;

FIG. 2 is an exploded perspective view of a first embodiment of the inventive antenna circuit where the radiating array comprises a ring slot;

FIG. 3 is a perspective view of the antenna circuit of FIG. 2;

BEST MODE(S) FOR CARRYING OUT THE INVENTION

Figure 4A:
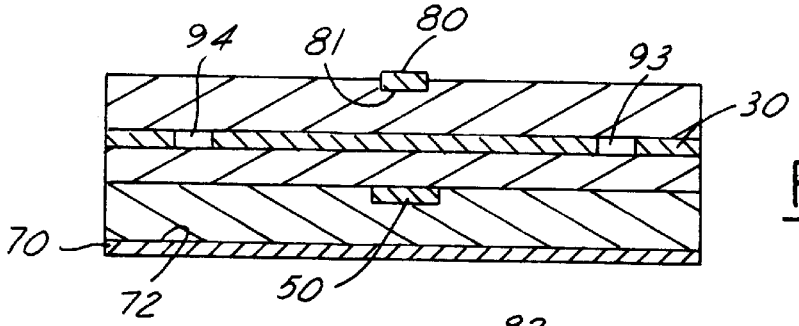
FIG. 4*a* is a cross-sectional view along line 4*a*—4*a* of FIG. 3.

The present invention will be described in terms of its operation in a transmit mode. Due to the principle of reciprocity, the invention works the same in a reverse order for the receive mode.

As shown in FIG. 1, antenna circuit 12 is ideal for use in a satellite 11 application as a result of its low profile and ease in which it can be configured into specialized geometries. Circuit 12 is a ring slot fed multi-band antenna that may use a micromachined electromechanical switch. An example of a suitable micromachined electromechanical switch is explained generally below with respect to FIG. 7.

Referring to FIGS. 2 and 3, a first embodiment of the inventive antenna circuit 12 is composed of a series of stacked layers. A first dielectric layer 20 is positioned adjacent to a top ground plane 30, which in turn is positioned adjacent to a second dielectric layer 40. The second dielectric layer 40 is positioned adjacent to a third dielectric layer 60, which in turn is adjacent to a bottom ground plane 70. A feed member 50 is interposed between the second dielectric layer 40 and the third dielectric layer 60.

An antenna member 80 is positioned on the top surface 22 of the first dielectric layer 20. First dielectric layer 20 further has a bottom surface 24, and a uniform thickness 26. The thickness 26 of the dielectric layer affects the electrical characteristics of the antenna as further described below.

The second dielectric layer 40 has a top surface 42, a bottom surface 44, and a uniform thickness 46. Secured to the top surface 42 is the bottom surface 32 of top ground plane 30.

Figure 5:
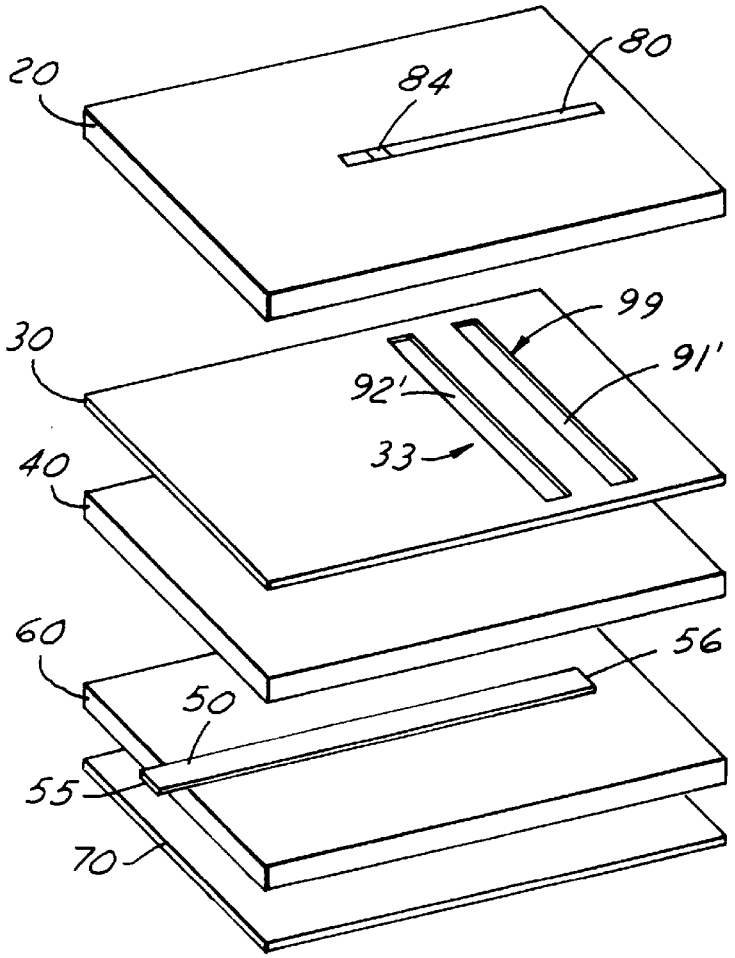
FIG. 5 is an exploded perspective view of a second embodiment of the inventive antenna circuit where the radiating array comprises dual slots.

A radiating array 33 is positioned within the top ground plane 30 and penetrates completely through it. This penetration can be achieved through numerous conventional processes, such as stamping, cutting, etching, and metal evaporation. The array 33 may take the form of numerous shapes, such as a slot ring 90 as shown in the first embodiment, or a dual slot configuration 99 as shown in FIG. 5. Although the manufacturing process may be less complicated for the dual slot configuration 99, the slot ring 90 requires less area on the face of the top ground plane 30 (with dual slots, the slots need to be longer). With either array, however, the same radiating frequency principles apply along with the same configuration alignments between the array 33 and the feed member 50.

The slot ring 90 is an opening within the top ground plane 30. The ring 90 is preferably of a rectangular shape where the two longest sides are defined by a first slot 91 and a second slot 92. Slots 91 and 92 are interconnected by a third slot 93 and a fourth slot 94 to form the ring.

As shown in FIG. 5, a second embodiment of the radiating array 33 has a dual slot configuration in place of a slot ring. The dual slot configuration 99 also contains a first slot 91' and a second slot 92'.

The slot ring 90 or the dual slot configuration 99 each have a first radiating frequency with a first wavelength 35 associated with the first slot 91 (or 91'), and a second radiating frequency with a second wavelength 38 associated with the second slot 92 (or 92'). Both the slot ring 90 and the dual slot configuration 99 form dual wavelengths to eliminate parasitic radiation at unwanted frequencies.

Once the radiating array 33 is formed the top ground plane 30 is secured to the first dielectric layer 20 with the antenna member 80 substantially perpendicular to the first and second slots 91 and 92.

The feed member 50, having a top surface 52, a bottom surface 54, a tap end 55 and a termination end 56, is secured to a top surface 62 of the third dielectric layer 60. The layer 60 also has a bottom surface 64 and a uniform thickness 66.

Figure 4B:
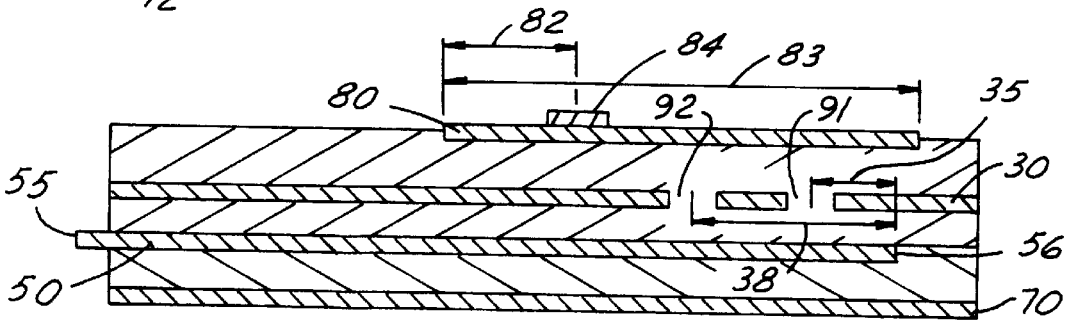
FIG. 4*b* is a cross-sectional view of the antenna circuit along line 4*b*—4*b* of FIG. 3.

The top surface 52 of feed member 50, along with the top surface 62 of dielectric layer 60, is secured to bottom surface 44 of second dielectric layer 40 so that the feed member 50 is also substantially perpendicular to the first and second slots 91 and 92. In addition, (as shown in FIG. 4*b*) the termination end 56 extends approximately one-half of the first wavelength 35 away from the first slot 91, and one-half of the second wavelength 38 away from the second slot 92. Such positioning eliminates cancellation and allows for maximum electromagnetic coupling between feed member 50 and antenna member 80. This coupling is further accentuated by correlating the first radiating frequency and the second radiating frequency with a high resonance frequency and a low resonance frequency of the antenna member 80.

Bottom ground plane 70 has a top surface 72 which is secured to the bottom surface 64 of third dielectric layer 60. As shown in FIG. 4*a*, the resultant formation has the feed member 50 surrounded by dielectric material and further interposed between the top ground plane 30 and the bottom ground plane 70. Ground planes 30 and 70 form planes which are held at the same electrical potential and have an area to prevent undesired radiation. In addition, the bottom ground plane 70 serves as a ground for the feed member 50 and eliminates any direct back radiation from the antenna member 80 and the radiating array 33.

As shown in FIG. 4*b*, the antenna member 80 has a first length 82 and a second length 83. The mechanical length of antenna element 80 characterizes the resonant frequency. The first length 82 corresponds to the high resonance frequency, and, the second length 83, being longer, corresponds to the low resonance frequency, thereby, providing a dual-band antenna. Only one frequency is transmitted at a particular time.

A switch member 84 is utilized to switch from the first length 82 to the second length 83. The switch member 84 may be located remotely, by utilization of leads (not shown), or, as preferred in this embodiment, by the use of a micromachined electromechanical switch mounted directly on the antenna member 80. In this regard, although any type of electromechanical switch may be utilized, the preferred switch is a micromachined electromechanical switch of the type disclosed in co-pending patent application Ser. No. 09/128,642, now U.S. Pat. No. 5,994,796, and entitled "Single-Pole Single-Throw Microelectro Mechanical Switch With Active Off-State Control" The disclosure of which is hereby incorporated by reference herein.

Figure 7:
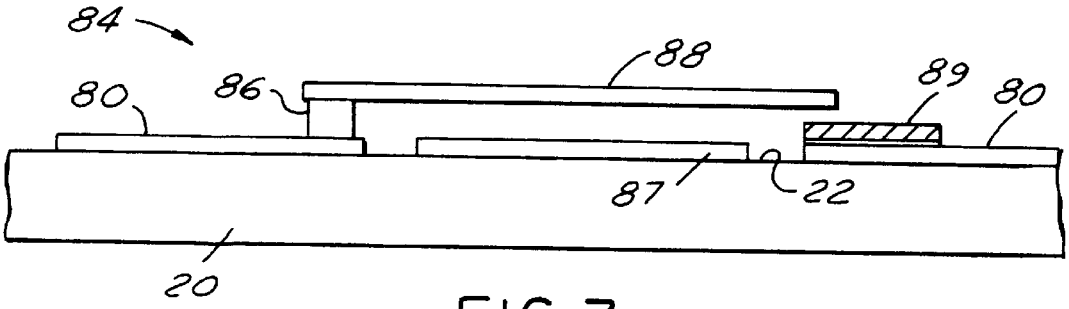
FIG. 7 is a detail of a micromachined electromechanical switch utilized with the present invention.

As shown in FIG. 7, the preferred micromachined electromechanical switch member 84 has a first control electrode 86, a second control electrode 87, a cantilevered beam 88 and a contact electrode 89. The first control electrode is connected to the first length 82 of the antenna member 80 and the cantilevered beam 88. The contact electrode 89 is mounted to the remaining portion of antenna member 80 beneath the cantilevered beam 88. The second control electrode 87 is coupled to the first dielectric layer top surface 22 beneath the beam 88.

When the switch member 84 is in the switch-closing phase, or ON-state, the actuation voltage, supplied by a feed line (not shown), exerts an electrostatic force of attraction on the beam 88 sufficient to overcome the stiffness of beam 88. As a result of the electrostatic force of attraction, the beam 88 deflects and makes a connection with the contact electrode 89, closing the switch member 84, thereby switching from the first length 82 to the second length 83.

For the embodiments shown in FIGS. 2–4 and 5 which comprise multiple layers, the preferred method of manufacture is to stack and assemble the members and layers in the orientations and positions shown and then laminate them together. Conventional lamination techniques can be used for this purpose.

With any of the embodiments of the invention, the feed member 50 is preferably an etched or plated 50 ohm stripline. The use of a symmetrical stripline for feed member 50 is also preferred in order to reduce conductor loss. In addition, a stripline has a well controlled characteristic impedance, low dispersion, and fields which propagate in a transverse electromagnetic mode.

Figure 6:
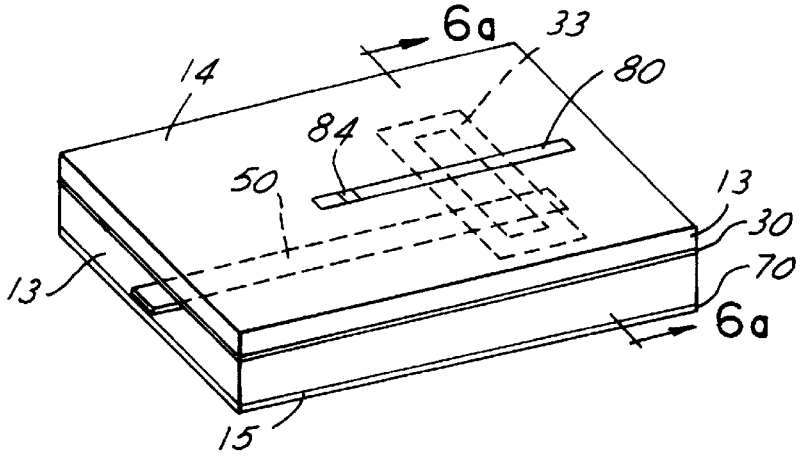
FIG. 6 is a perspective view of another embodiment of the inventive antenna circuit.
Figure 6A:
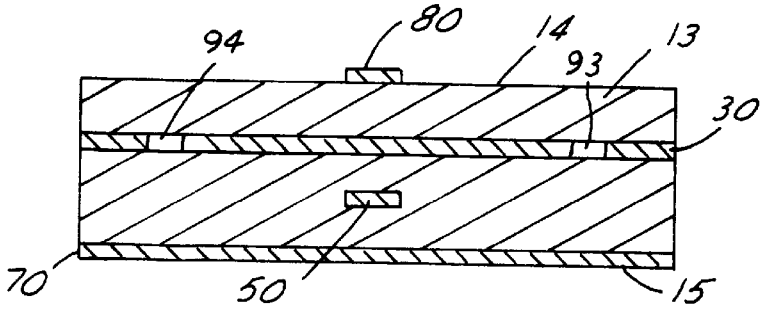
FIG. 6*a* is a cross-sectional view of the antenna circuit along line 6*a*—6*a* of FIG. 6.

The metallic, electrically-conductive sheets which comprise the top ground plane 30 and the bottom ground plane 70 are typically provided in laminar form, and can be made of gold plating, copper cladding, or other conductive compositions. Specific shapes for the radiating array 33 may be obtained utilizing photolithography, metal evaporation, or etching techniques. Another embodiment of the invention is shown in FIGS. 6 and 6*a*. This embodiment eliminates the dielectric layers and instead uses a molded continuous dielectric substrate or medium 13. Substrate 13 has a top surface 14 which abuts the antenna member bottom surface 81, and a bottom surface 15 which abuts the bottom ground plane top surface 72. For manufacture, this embodiment requires that antenna member 80, top ground plane 30, radiating array 33, feed member 50, and bottom ground plane 70 be suspended or held within their respective orientations to one-another. While in that position, the dielectric substrate 13 may then be formed or molded above the bottom ground plane 30 and about the remaining elements. For example, if the dielectric is in liquid form during the manufacturing process, it can be poured about the above mentioned elements prior to solidification.

It is clear to one skilled in the art that the dual-band antenna principals of the present invention can be broadened to a multi-band application by providing additional lengths to the antenna member 80 and additional slots to the dual slot configuration 99 while maintaining respective and associated frequencies to ensure optimum antenna efficiency. Additional lengths can be provided, for example, by positioning additional micromachined electro-mechanical switches on the antenna member 80. Also, additional slots can be provided on the top ground plane 30 parallel to slots 91 and 92. It is further clear that slot fed multi-band antenna circuit 12, as a single circuit, replaces the need for multi-circuits when multi-transmitting frequency bands are desired. Utilizing a single circuit simplifies integration of components, reduces weight, and utilizes less space. Such advantages are particularly important when the antenna is applied to airborne or satellite applications.

The present inventive antenna has numerous applications and uses. It can be utilized, for example, in various antenna applications, such as electronically scanned arrays, slot antenna arrays, patch antenna arrays, Doppler radar antennas, dual band antennas, dual polarized antennas, and single element antennas used in automotive, communications and military industries.

The inventive antenna and associated feed structures may be fabricated accurately and cost effectively, due to their use of either photographic techniques to etch circuits or other processes of depositing metals using sputtering techniques or removing metal by evaporation techniques. Since the circuits can be fabricated with high precision, they can be designed for RF to millimeter-wave applications.

It should be understood that the forms of the invention herein disclosed are presently the preferred embodiments and many others are possible. It is not intended herein to mention all of the possible equivalent forms or ramifications of the invention. It is understood that the terms used herein are merely descriptive rather than limiting, and that various changes may be made without departing from the spirit or scope of the invention as defined by the appended claims.

What is claimed is:

1. An antenna circuit comprising:

an antenna member having a first length with a high resonance frequency, a second length with a low resonance frequency, and a switch member for alternating between said first length and said second length;

a dielectric substrate coupled to said antenna member;

a bottom ground plane adjacent to said dielectric substrate;

a feed member positioned in said dielectric substrate, said feed member interposed between said bottom ground plane and said antenna member; and a top ground plane interposed between said dielectric substrate and said antenna member, said top ground plane containing a radiating array having a first radiating frequency and a second radiating frequency.

2. The antenna circuit as claimed in claim 1 wherein said first radiating frequency is associated with said high resonance frequency and said second radiating frequency is associated with said low resonance frequency in order to provide maximum excitation of said antenna member.

3. The antenna circuit as claimed in claim 2 wherein said radiating array comprises a dual slot configuration having:

a first slot having a first wavelength associated with said first radiating frequency, said first slot being substantially perpendicular to said antenna member; and a second slot having a second wavelength associated with said second radiating frequency, said second slot being substantially parallel to said first slot.

4. The antenna circuit as claimed in claim 3 wherein said first and second slots are substantially perpendicular to said feed member and where said feed member has a termination end located one-half said first wavelength from said first slot and where said termination end is located one-half said second wavelength from said second slot.

5. The antenna circuit as claimed in claim 3 further comprising a third and a fourth slot interconnecting said first and second slots forming a ring slot.

6. The antenna circuit as claimed in claim 5 wherein said ring slot has said first and second slots substantially perpendicular to said feed member and where said feed member has a termination end located one-half said first wavelength from said first slot and where said termination end is located on-half said second wavelength from said second slot.

7. The antenna circuit as claimed in claim 1 wherein said top ground plane and said bottom ground plane comprise copper cladding.

8. The antenna circuit as claimed in claim 1 wherein said top ground plane and said bottom ground plane comprise gold plating.

9. The antenna circuit as claimed in claim 1 wherein said switch member comprises a micromachined electromagnetic switch.

10. The antenna circuit as claimed in claim 1 wherein said feed member comprises a stripline member.

11. The antenna circuit as claimed in claim 1 wherein said antenna member is selected from a group consisting of a slot antenna, a patch antenna, and a dipole antenna.

12. A method of transmitting a high and a low resonance frequency from an antenna circuit, comprising the steps of:

energizing a tap end of a feed member to produce an electromagnetic field;

energizing a radiating array by the electromagnetic field;

radiating a first radiating frequency with a first wavelength associated with a first slot and a second radiating frequency with a second wavelength associated with a second slot through the energized radiating array;

resonating a single antenna member by the first and the second radiating frequencies;

generating, alternately, the high resonance frequency and the low resonance frequency from a first length and a second length of the single antenna member, respectively.

13. A method of transmitting a high and a low resonance frequency as claimed in claim 12, further comprising the steps of:

switching to the second length by closing a switch member; and switching to the first length by opening the switch member.

14. A method of transmitting a high and a low resonance frequency as claimed in claim 13, further comprising the steps of:

opening and closing the switch member by use of electrical power where the switch member is a micromachined electromechanical switch.

15. A method of transmitting a high and a low resonance frequency as claimed in claim 12, further comprising the steps of:

holding a top ground plane and a bottom ground plane to the same potential so that the top ground plane containing the radiating array (33) eliminates unwanted electromagnetic radiation and the bottom ground plane acts as a ground for the feed member and suppresses unwanted background and parasitic radiation.

* * * * *